US006474124B1

(12) United States Patent
Leftwich

(10) Patent No.: US 6,474,124 B1
(45) Date of Patent: Nov. 5, 2002

(54) COLD STEEL CAMBERING APPARATUS AND METHOD

(75) Inventor: William B Leftwich, Elkhart, IN (US)

(73) Assignee: Banks Corporation, Elkhart, IN (US)

( * ) Notice: Subject to any disclaimer, the term of this patent is extended or adjusted under 35 U.S.C. 154(b) by 0 days.

(21) Appl. No.: 09/711,456

(22) Filed: Nov. 13, 2000

Related U.S. Application Data

(60) Provisional application No. 60/165,159, filed on Nov. 12, 1999.

(51) Int. Cl.[7] ..... B21D 7/06

(52) U.S. Cl. ..... 72/296; 72/385; 72/389.6; 72/705

(58) Field of Search ..... 72/296, 297, 389.1, 72/389.6, 385, 702, 305, 311, 295, 705

(56) References Cited

U.S. PATENT DOCUMENTS

| | | | | |
|---|---|---|---|---|
| 853,513 | A | | 5/1907 | Keith et al. |
| 1,037,301 | A | * | 9/1912 | Paine |
| 1,095,299 | A | | 5/1914 | Tils |
| 1,605,372 | A | | 11/1926 | Pelizzoni |
| 1,777,686 | A | | 10/1930 | Bagge |
| 1,815,180 | A | | 7/1931 | Bennett |
| 1,845,532 | A | | 2/1932 | Titus |
| 1,869,905 | A | | 8/1932 | Marsh et al. |
| 2,022,912 | A | * | 12/1935 | Heineman |
| 2,263,272 | A | | 11/1941 | Moss |
| 2,718,913 | A | * | 9/1955 | Smith |
| 2,887,762 | A | | 5/1959 | Dobell |
| 3,292,410 | A | * | 12/1966 | Baldassano ..... 72/295 |
| 3,300,839 | A | | 1/1967 | Lichti |
| 3,557,586 | A | * | 1/1971 | Zmuda ..... 72/296 |
| 4,055,061 | A | * | 10/1977 | Bayorgeon et al. ..... 72/705 |
| 4,586,646 | A | | 5/1986 | Booher |
| 4,709,456 | A | | 12/1987 | Iyer |
| 4,761,984 | A | * | 8/1988 | Fuscaldo, Jr. ..... 72/705 |
| 4,949,565 | A | * | 8/1990 | Kodera |
| 5,509,289 | A | * | 4/1996 | Narragon ..... 72/705 |
| 5,600,932 | A | | 2/1997 | Paik et al. |

FOREIGN PATENT DOCUMENTS

| | | | | |
|---|---|---|---|---|
| DE | 681629 | * | 9/1939 | ..... 72/389.1 |

* cited by examiner

*Primary Examiner*—Daniel C. Crane
(74) *Attorney, Agent, or Firm*—Clifford W. Browning; Woodard, Emhardt, Naughton, Moriarty & McNett

(57) ABSTRACT

A cold steel cambering apparatus and method of use, the apparatus comprising, a cambering assembly having a forward-most end and a rearward-most end and therebetween a plurality of adjustable beam guides, each having means to restrain lateral movement of at least one cold steel beam placed on the cambering assembly, with a plurality of guides also having second means to restrain upward movement of at least one cold steel beam placed on the cambering assembly; and at least one hydraulic lift cylinder positioned directly under at least one cold steel beam placed on the cambering assembly with means to impart a concave or upward camber to at least one cold steel beam placed on the cambering assembly over the forward hydraulic cylinder and restrained by the means to restrain lateral and upward movement.

8 Claims, 7 Drawing Sheets

COLD STEEL CAMBERING APPARATUS AND METHOD

This application claims the benefit of prior Provisional Patent Application Ser. No. 60/165,159, filed on Nov. 12, 1999.

The present invention relates generally to the field of devices and methods for applying a camber to steel beams, and more particularly to an apparatus and method for applying a cold camber to steel beams such as those used in the manufacture of steel frames for trailers.

BACKGROUND OF THE INVENTION

In the construction of steel frames for large trailers of all types, it is well known that it is highly advantageous to apply a camber to the main steel beams of the trailers, whether they are tubes, I-beams or C-channel. When trailer frames with appropriate cambers in their main beams are under load, the main steel beams bend until they are substantially straight, but do not sag, as would have been the case if the main steel beams lacked a camber before being put under load. Heretofore, cambers have been imparted to the main steel beams of trailers by applying heat to the top or bottom of the steel beams as a sharp bending force is applied to the opposite sides of the beams. The result has been cambers in the steel beam with relatively sharp kinks where bending forces have been applied during the heated cambering process.

SUMMARY OF THE INVENTION

The present invention provides a novel cold cambering apparatus and method for imparting cambers to the steel beams used in the manufacture of frames for trailers that eliminates the sharp kinks imparted to steel beams during the heated cambering process of the prior art. The present invention may be used to impart a cold camber to steel I- and C-channel beams, as well as tubes, either individually, or after they have been incorporated into a trailer frame. It has also been discovered that cold cambering imparts a camber that holds better than a comparable heat induced camber. In addition, the cold camber imparted to steel beams is in the form of a preferred long sweeping arch as opposed to the cambers with sharp kinks typically found in heat-induced cambers of the prior art.

One preferred embodiment of the present invention is a cold steel cambering apparatus, comprising, a moveable forward cambering assembly having a forward-most end and a rearward-most end and therebetween a plurality of adjustable beam guides, each having first means to restrain lateral movement of at least one cold steel beam placed on the forward cambering assembly, with a plurality of guides at the ends also having second means to restrain upward movement of at least one cold steel beam placed on the forward cambering assembly; and at least one forward hydraulic lift cylinder positioned midway between the ends and directly under at least one cold steel beam placed on the forward cambering assembly with third means to impart a concave camber to at least one cold steel beam placed on the forward cambering assembly over the forward hydraulic cylinder that is restrained by said first and second means; a moveable rear cambering assembly-aligned with the forward cambering assembly and.having a forward-most end and a rearward-most end and therebetween a plurality of adjustable beam guides,.each having fourth means to restrain lateral movement and fifth means to restrain upward movement of at least ore cold steel beam placed simultaneously on the rear cambering assembly and the forward cambering assembly, and at least one pair of rear hydraulic lift cylinders positioned to be at the rearward-most end portion of the rear cambering assembly and directly under at least one cold steel beam placed on the rear cambering assembly with sixth means to impart an upward camber to at least one cold steel beam placed on the rear cambering assembly over the rear hydraulic lift cylinders and restrained by the fourth and fifth means.

Another preferred embodiment of the present invention is a cold steel cambering apparatus, comprising, a cambering assembly having a forward-most end and a rearward-most end and therebetween a plurality of adjustable beam guides, each having first means to restrain lateral movement of at least one cold steel beam placed on the cambering assembly, with a plurality of guides at the ends also having second means to restrain upward movement of at least one cold steel beam placed on the cambering assembly; and at least one hydraulic lift cylinder positioned midway between the ends and directly under at least one cold steel beam placed on the cambering assembly with means to impart a concave camber to at least one cold steel beam placed on the cambering assembly over the forward hydraulic cylinder and restrained by the first and second means.

Another preferred embodiment of the present invention is a cold steel cambering apparatus, comprising, a cambering assembly having a forward-most end and a rearward-most end and therebetween a plurality of adjustable beam guides, each having first means to restrain lateral movement and second means to restrain upward movement of at least one cold steel beam placed on the cambering assembly, and at least one pair of rear hydraulic lift cylinders positioned to be at the rearward-mo st end portion of the rear cambering assembly and directly under at least one cold steel beam placed on the rear cambering assembly with means to impart an upward camber to at least one cold steel beam placed on the cambering assembly over the rear hydraulic lift cylinders and restrained by the first and second means.

Another preferred embodiment of the present invention is a method of providing a camber to a cold steel beam, comprising, providing a moveable forward cambering assembly having a forward-most end and a rearward-most end and therebetween a plurality of adjustable beam guides, each having first means to restrain lateral movement of at least one cold steel beam placed on the fo rw ard cambering assembly, with a plurality of guides at the ends also having second means to restrain upward movement of at least one cold steel beam placed on the forward cambering assembly; and at least one forward hydraulic lift cylinder positioned midway between the ends and directly under at least one cold steel beam placed on the forward cambering assembly with third means to impart a concave camber to at least one cold steel beam placed on the forward cambering assembly over the forward hydraulic cylinder and restrained by said first and second means; and a moveable rear cambering assembly aligned with the forward cambering assembly and having a forward-most end and a rearward-most end and therebetween a plurality of adjustable beam guides, each having fourth means to restrain lateral movement and fifth means to restrain upward movement of at least one cold steel beam placed simultaneously on the rear cambering assembly and the forward cambering assembly, and at least one pair of rear hydraulic lift cylinders positioned to be at the rearward-most end portion of the rear cambering assembly and directly under at least one cold steel beam placed on the rear cambering assembly with sixth means to impart an upward camber to at least one cold steel beam placed on the rear cambering assembly over the rear hydraulic lift cylinders and restrained by said fourth and fifth means; and at least one cold steel beam to be cambered; adjusting the separation between the rear and forward cambering assemblies in direct relation to the length of at least one cold steel beam of the providing step; first positioning of at least one cold steel beam of the providing step on the forward cambering assembly with the desired center of a forward concave camber to be imparted to at least one cold steel beam of the providing step over at least one of the forward hydraulic lift cylinder; second positioning of at least one cold steel beam of the providing step on the rear cambering assembly with the end of each beam overlaying at least one rear hydraulic lift cylinders; capturing at least one cold steel beam of the providing step with the forward and rear adjustable beam guides; first lifting at least one of the forward hydraulic lift cylinders to bend at least one cold steel beam of the providing step to a point greater than a desired camber in the beam and holding the forward hydraulic lift cylinder at that point; second lifting at least one of the rear hydraulic lift cylinders to bend at least one cold steel beam of the providing step to a point greater than a desired camber in the beam and holding the rear hydraulic at that point; and lowering the forward and rear hydraulic lift cylinders and checking for desired final camber dimensions in the beam.

Related objects and advantages of the present invention will be apparent from the following descriptions.

BRIEF DESCRIPTIONS OF THE DRAWING FIGURES

DETAILED DESCRIPTION OF THE PREFERRED EMBODIMENTS

Figure 1:
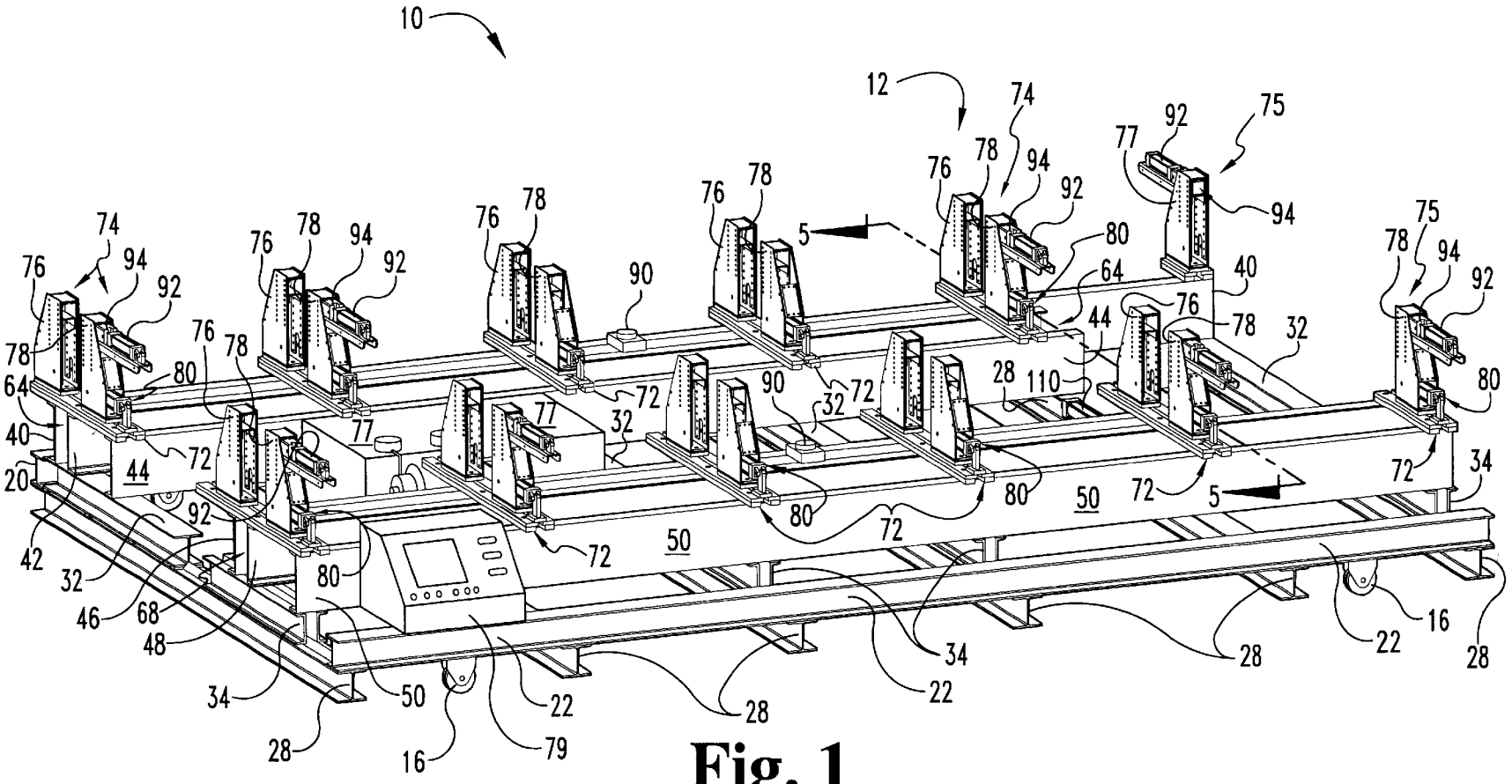
FIG. 1 is a perspective view of the front cambering assembly of the preferred embodiment of the present invention.

Referring now to the drawings, the cold steel cambering apparatus 10 of the present invention comprises independent forward 12 and rear 14 cambering assemblies, both of which are moveable on wheels 16,18 respectively, to allow them to be adjustably spaced apart to accommodate beams and frames of varying lengths. The wheels 16,18 are mounted to longitudinal lower support beams 20,22 and 24,26 of the forward 12 and rear 14 cambering assemblies, respectively, which support lower cross support beams 28,30, respectively. Lower cross support beams 28,30 directly support upper cross support beams 32,34 of the forward cambering assembly 12 and upper cross support beams 36,38 of the rear cambering assembly 14. Upper cross support beams 32,36 of the forward 12 and rear 14 cambering assemblies, respectively, are fixed to lower cross support beams 28,30, respectively. Upper cross support beams 34,38 are slidingly attached to lower cross support beams 28,30, respectively, with conventional means such that upper cross support beams 34 and 38 slide atop and parallel to lower support beams 28,30, respectively. In the preferred embodiment to date, the lower support beams and the upper and lower cross support beams have been steel I-beams.

Mounted to the upper cross support beams 32,34,36,38 are upper support beams 40,42,44,46,48,50;52,54,56,58,60, 62 all of which have been C-channel steel beams in the preferred embodiment to date. The upper support beams are aligned in parallel relationship with each other and with the longitudinal lower support beams 20,22,24,26. Upper support beams 40,42,44 and 52,54,56 are affixed to the fixed upper cross support beams 32,36 of the forward 12 and rear 14 cambering assemblies. Upper support beams 40,42, and 52,54, which are C-channel steel beams in the preferred embodiment to date, are mounted to the upper cross support beams 32,36, respectfully, with their flanges oriented outwardly, thereby forming parallel open channels 64,66, respectively, between them along their entire lengths. Upper support beams 46,48,50 and 58,60,62 are affixed to the moveable upper cross support beams 34,38 of the forward 12 and rear 14 cambering assemblies, respectively. Upper support beams 46,48 and 58,60, also being C-channel beams in the preferred embodiment to date, are mounted to the upper cross support beams 34,38, respectfully, with their flanges oriented outwardly, thereby forming parallel open channels 68,70, respectfully, between them along their entire lengths.

Spanning the open channels 64,68 and 66,70 at right angles are a plurality of slide tracks 72, which are secured to the upper support beams 40,42,44,46,48,50;52, 54,56,58, 60,62. Slide tracks 72 slidingly support beam guides 74. Beam guides 74 are slidingly mounted in pairs, with the exception of the split single guide 75 mounted on the forward-most end of forward cambering assembly 12, to the slide tracks 72 to provide lateral support to beams loaded for cambering and to prevent the beams from bending sideways during the cambering process. One of each pair of beam guides 74 and 75 on the forward cambering assembly 12 of the preferred embodiment to date is fixed in position at the edge of open channels 64,68 to provide a fixed lateral guide and support for a beam to be cambered. All of these fixed beam guides 76,77 are on the same side of either open channels 64,68. Opposite each fixed beam guide 76,77 on the forward cambering assembly 12, noting the exception of guide 75 on forward cambering assembly 12, is a slidingly adjustable beam guide 78, the position of which along its slide track 72 is controlled by forward bottom hydraulic pistons 80. Forward bottom hydraulic pistons 80 allow the adjustable beam guides 78 to be selectively positioned against beams of varying widths that are positioned between the pairs of beam guides 74,75.

On the rear cambering assembly 14, one of each pair of beam guides 74 located above open channel 66 is fixed in position at the edge of open channel 66 to provide a fixed lateral guide and support for a beam to be cambered. All of these fixed beam guides 82 are on the same side of open channel 66. Opposite each fixed beam guide 82 is a slidingly adjust able beam guide 84 the position of which along its slide track 72 is controlled by rear bottom hydraulic piston 86. Rear bottom hydraulic pistons 86 allow the adjustable beam guides 84 to be selectively positioned against be ams of varying widths that ar e positioned between the pairs of beam guides 74 over open channel 66 for cambering.

Both of each pair of beam guides 74 located above open channel 70 on the rear cambering assembly 14 are slidingly adjustable along their slide tracks 72 with the positions of each controlled by rear bottom hydraulic pistons 88. The adjustability of both of these pairs of beam guides 74 permits the rear camber ing assembly 14 of the present invention to adjust to a wide variety of rear portions of beams to be chambered. It is in the rear of trailers, for example, where two beams may be overlapped to provide extra strength for axle and wheel assemblies.

In the preferred embodiment to date, forward cambering assembly 12 has been provided with eleven pairs of beam guides 741 five each over the open channel 64, five each over the open channel 68, and one pair 75 at the forward-most end spanning beams 40,48.

Single fixed beam guide 77 is provided at the forward-most end of forward cambering assembly 12, to allow opening up of the front of assembly 12 by cutting back upper support beams 42,44,46. The removal of a portion of the beams 42,44,46 provides clearance for the under slung hitch of a trailer frame. This allows the centerline of the front camber to be closer to the hitch by approximately five feet, which is important for shorter trailer frames.

Fitted into the middle of each open channel 64,68 of forward cambering assembly 12 at approximately the mid-point thereof is a front hydraulic lift cylinder 90 to force steel beams upward to impart a concave camber to the beams. To restrain beams at the ends of the desired concave chamber, the four slidingly adjustable beam guides 78 at each end of the forward cambering assembly 12, as well as fixed beam guide 77, are further provided with top forward hydraulic pistons 92 that are attached to forward hydraulic piston bolts 94. Bolts 94 span the gap between the tops of these pairs of beam guides 74 when the slidingly adjustable beam guides 78 are positioned against beams by forward bottom hydraulic pistons 80, so the bolts 94 are partially received within each and overlie steel beams lying there between. The exception is fixed beam guide 77, the bolt 94 of which is extendible but is not received within a corresponding beam guide.

Bolts 94 will then restrain beams against upward movement at all these locations when front hydraulic lift cylinders 90 move upward against beams mounted in forward cambering assembly 12 to impart a concave camber to the beams.

Figure 2:
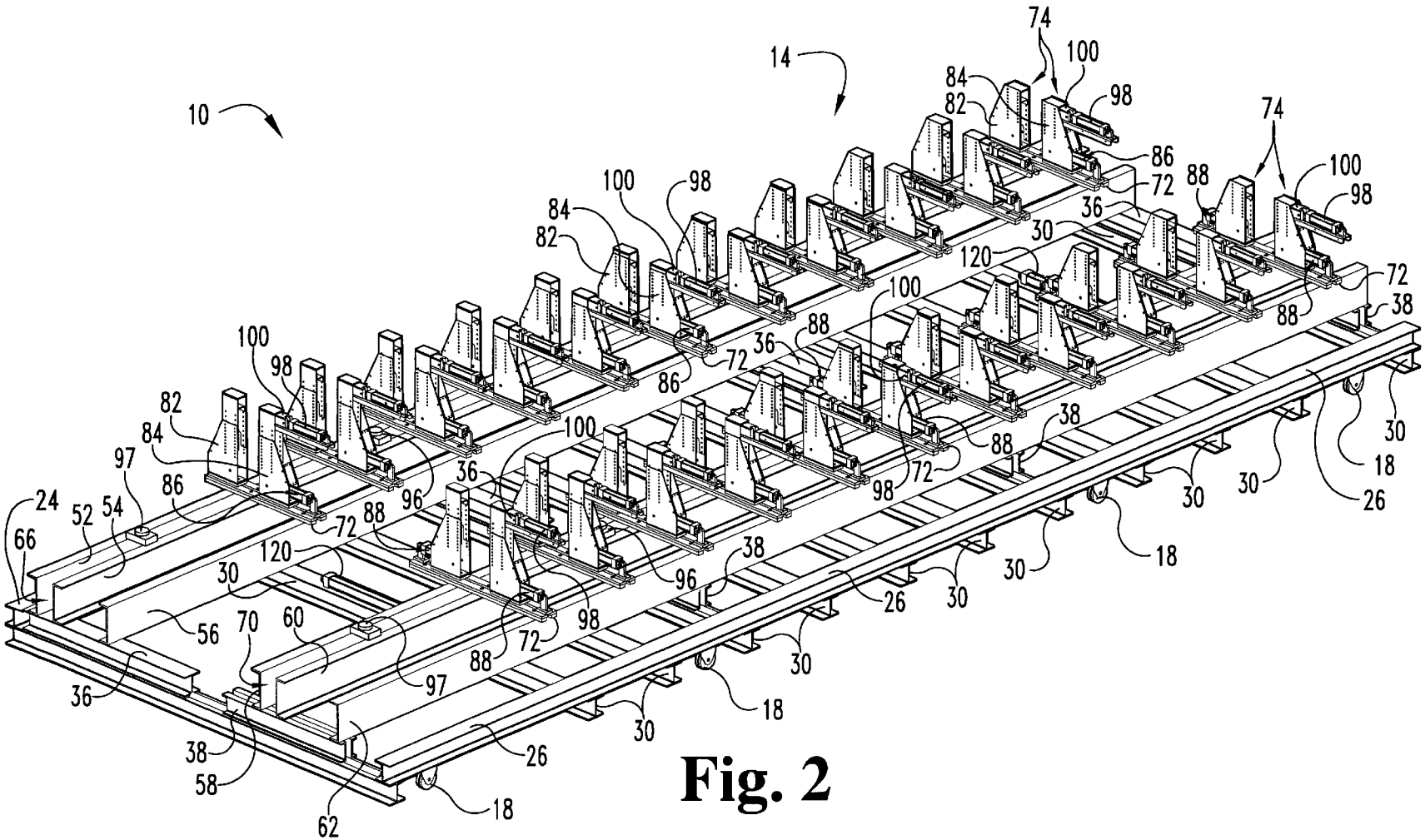
FIG. 2 is a perspective view of the rear cambering assembly of the preferred embodiment of the present invention.

In the preferred embodiment to date, rear-cambering assembly 14 has been provided with twenty-two pairs of beam guides 74, eleven each over the open channels 66,70. Fitted into the rear-most portions of each open channel 66, 70 of rear cambering assembly 14 are a pair of rear hydraulic lift cylinders 96,97, each separately programmable, to force steel beams upward to impart an upward camber to the rear-most portions of the beams. To restrain beams forward of the desired upward camber imparted by the lift cylinders 96,97 the slidingly adjustable beam guides 84 along open channel 66 are further provided with top rear hydraulic pistons 98 that are attached to rear hydraulic piston bolts 100. Similarly, one of each pair of slidingly adjustable beam guides 74 along the same side of open channel 70 is further provided with a top rear hydraulic piston 98 that is attached to a rear hydraulic piston bolt 100. Bolts 100 span the gap between the tops of each pair of adjustable beam guides 74 when the pairs of beam guides 74 are all positioned against a beam, so the bolts 100 are partially received within each and overlie beams lying there between. Bolts 100 will restrain a beam from upward movement when the rear hydraulic lift cylinders 96 move upward against a beam. As illustrated in FIG. 2, the heights of the pairs of beam guides 74 in the rear cambering assembly 14 grow progressively taller from the front to the rear of rear cambering assembly 14. Thus, the relative heights of bolts 100 grow progressively taller from the front to the rear of rear cambering assembly 14. This allows a beam to arc upwardly from the front to the rear of rear cambering assembly 14 as lift cylinders 96 and 97 are raised upwardly.

Figure 3:
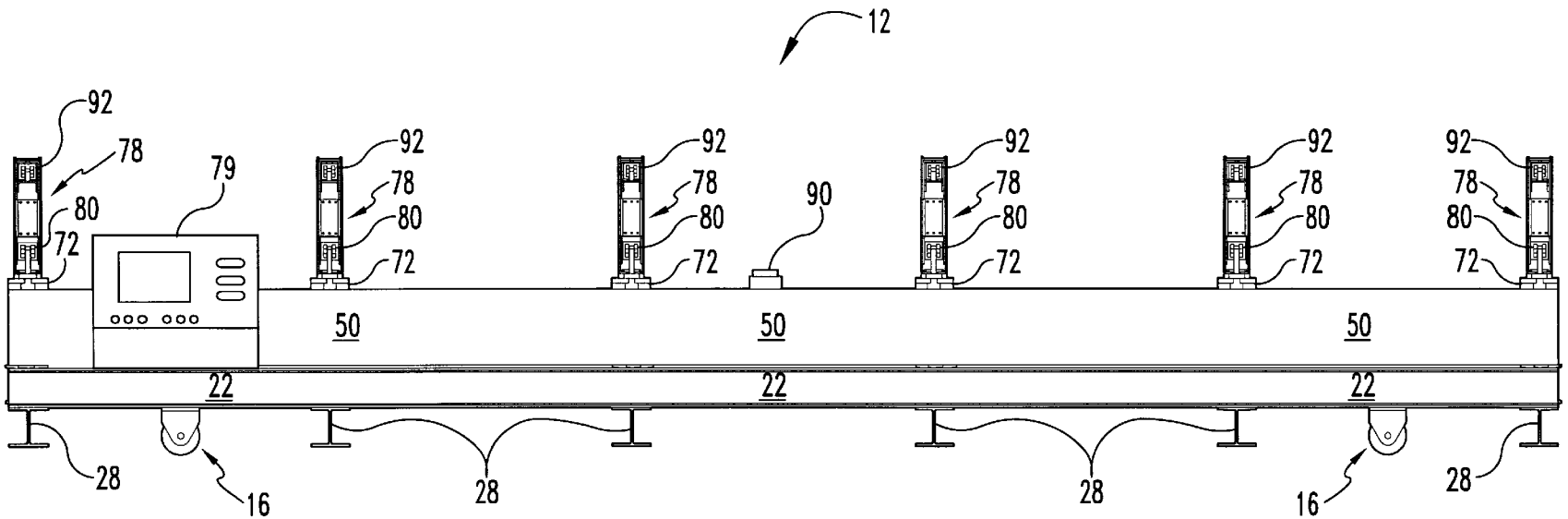
FIG. 3 is a right-side view of the front cambering assembly of FIG. 1.
Figure 4:
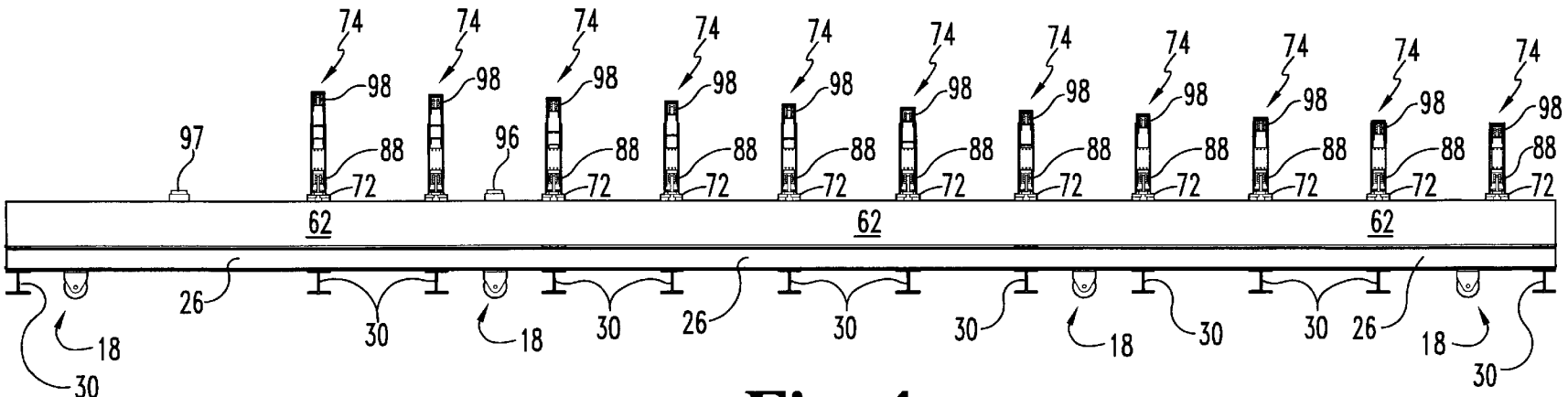
FIG. 4 is a right-side view of the rear cambering assembly of FIG. 2.
Figure 5:
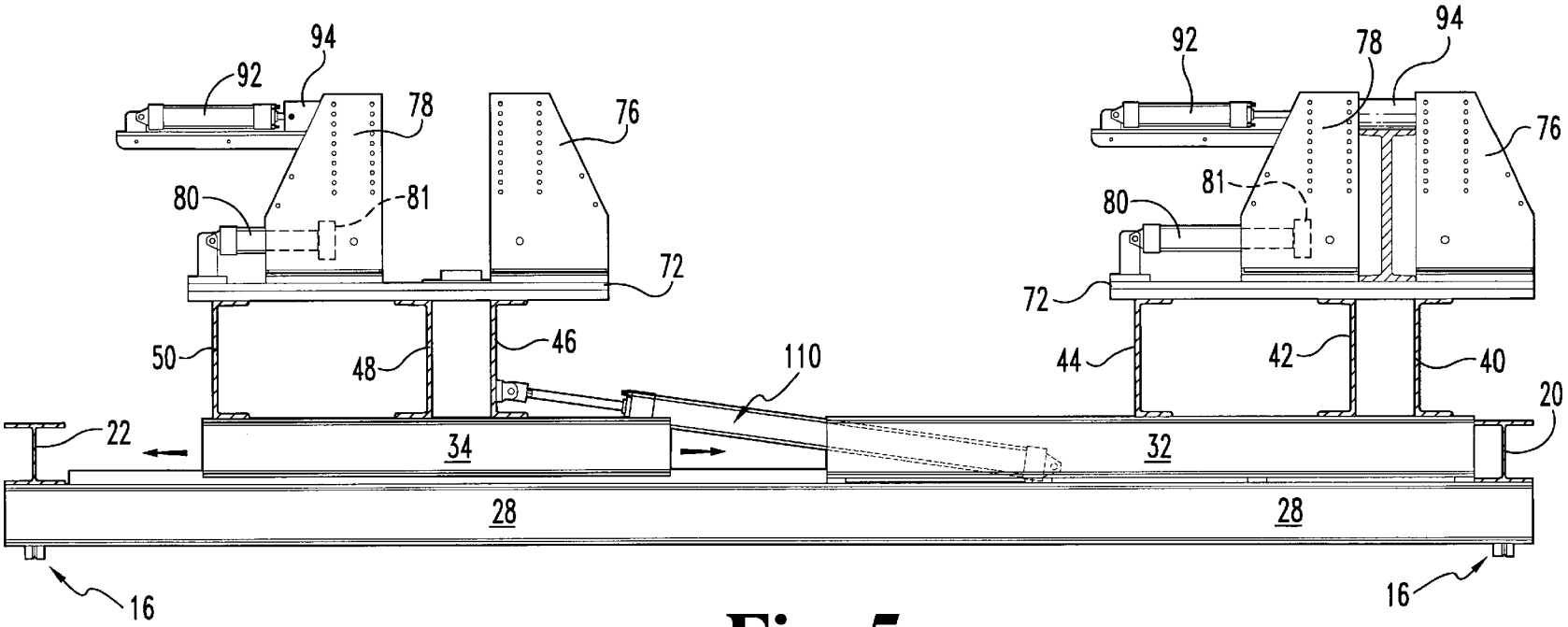
FIG. 5 is a sectional front-end view of the front cambering assembly of FIG. 1, taken along line 5—5, illustrating a single beam mounted for cambering.
Figure 6:
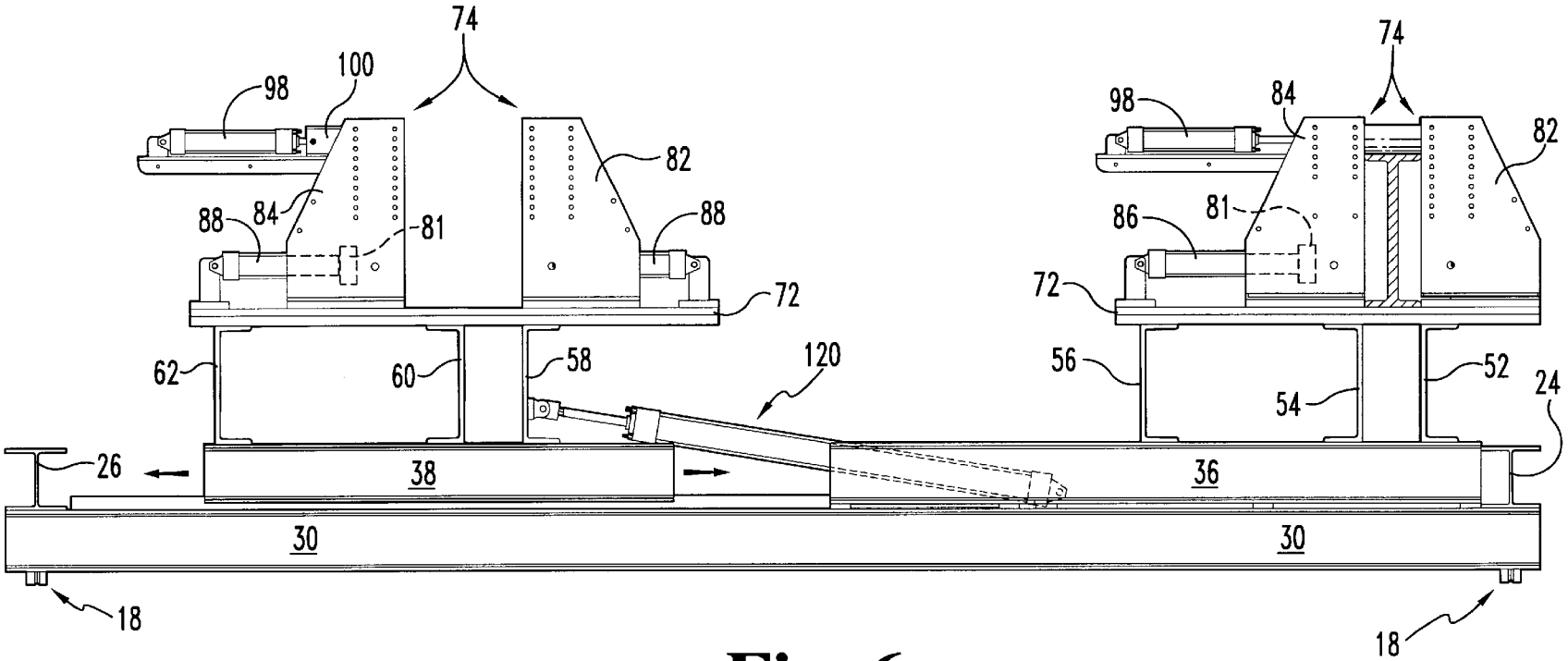
FIG. 6 is a front-end view of the rear cambering assembly of FIG. 2, illustrating a single beam mounted for cambering.
Figure 7:
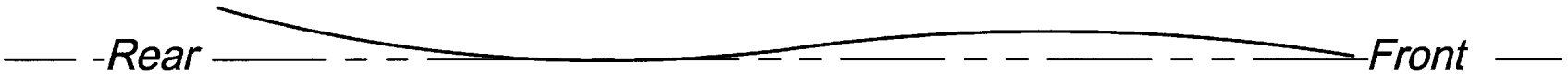
FIG. 7 is a representation of the general shape of the desired camber in beams utilized in the manufacture of large trailers.

The conventional hydraulic and associated feed tubes, hoses and control lines for all pistons and lift cylinders are not being illustrated in any drawing figures to eliminate unnecessary clutter. All feed tubes, hoses and control lines are located on the forward 12 and rear 14 cambering assemblies and are routed through telescoping tunnels to allow for length change. The hydraulic power supply 77 is illustrated in FIGS. 1 and 3.

In the preferred embodiment to date, the operation of all the hydraulic lift cylinders 90,96,97 and pistons 80,92,86, 88,98 are controlled by conventional CNC hardware and technology that are well known and understood by those skilled in the art. The computer/control panel 79 that controls the operation of all hydraulic lift cylinders and pistons of the preferred embodiment to date is illustrated in FIGS. 1 and 3.

In an operative alignment, the cambering apparatus 10 of the preferred embodiment to date has the forward cambering assembly 12 aligned with the rear cambering assembly 14 such that open channel 64 of the forward cambering assembly 12 is in alignment with the open channel 66 of the rear cambering assembly 14. The separation between the forward 12 and rear 14 cambering assemblies depends upon the length of the beams to be cold cambered. If a single beam is to be cold cambered, it will be positi oned over open channels 64,66 with the beam positioned so that the desired center of the forward concave camber is positioned over the front hydraulic lift cylinder 90 within open channel 64. The rear cambering apparatus 14 will be positioned relative to the front cambering apparatus 12 such that the end of the beam to be cambered overlays the rear hydraulic lift cylinder 97 within open channel 66. The slidingly adjustable beam guides 78,84 are then positioned to snuggly capture the beam between them and their corresponding fixed beam guides 76,82 through the actions of pistons 80,92,86,88,98, which are each provided with a 5/16 inch stroke PANCAKE brand cylinder 81 which is a short-stroke, large-bore hydraulic cylinder. The PANCAKE brand cylinders 81 eliminate the need to verify the dimension differences between single beam frames and double beam frames. The PANCAKE brand cylinders 81 permit each adjustable beam guides 78,84 to apply the proper snug capture clearance regardless of beam dimensional variations.

Next, the piston bolts 94,100 extend over the beam. Then front hydraulic lift cylinders 90 in open channel 64 lifts to a selected dimension and is held. The dimension selected will be slightly larger than the desired final camber dimension. Next, the rear hydraulic lift cylinder 96 in open channel 66 will lift up, again to a dimension slightly larger than the desired final camber dimension, and is held five seconds. The front and rear hydraulic lift cylinders are then both lowered and the beam is checked for desired camber dimensions. If the desired dimensions have not been obtained, the hydraulic lift cylinders 90 are raised again in the same sequence, followed by additional dimension checks. It is known that the steel must be over bent wvhen cold cambered to obtain the desired permanent cold camber dimension. When the desired permanent dimensions have been obtained, all hydraulic lifts and pistons are retracted and the beam is removed.

The cambering apparatus of the present invention provides flexibility in handling individual beams of 8, 10 or 12 inches. It also permits pre-welded trailer frames having two main beams of 8, 10 or 12 inches and multiple smaller cross beams to be mounted directly on the cambering apparatus 10 and a cold camber applied to the two main beams simultaneously. The relative positions of the open channels 68,70 and the open channels 64,66 may be changed to accommodate frames of varying widths by utilizing forward frame hydraulic pistons 110, which are attached to upper support beam 46, and rear frame hydraulic pistons 120, which are attached to upper support beam 58. The sequencing of the cold cambering steps for a completed frame is the same as that set forth above for an individual beam, above.

While the preferred embodiment of the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

I claim:

1. A cold steel cambering apparatus, comprising:

a mobile forward cambering assembly having a forward-most end and a rearward-most end and therebetween a plurality of adjustable beam guides, each having first means to restrain lateral movement of at least one cold steel beam placed on the forward cambering assembly, with a plurality of guides at the ends also having second means to restrain upward movement of at least one cold steel beam placed on the forward cambering assembly; and at least one forward hydraulic lift cylinder positioned midway between the ends and directly under at least one cold steel beam placed on the forward cambering assembly with third means to impart a concave camber to at least one cold steel beam placed on the forward cambering assembly over the forward hydraulic cylinder and restrained by said first and second means;

a separable mobile rear cambering assembly aligned with the forward cambering assembly and having a forward-most end and a rearward-most end and therebetween a plurality of adjustable beam guides, each having fourth means to restrain lateral movement and fifth means to restrain upward movement of at least one cold steel beam placed simultaneously on the rear cambering assembly and the forward cambering assembly, and at least one pair of rear hydraulic lift cylinders positioned to be at the rearward-most end portion of the rear cambering assembly and directly under at least one cold steel beam placed on the rear cambering assembly with sixth means to impart an upward camber to at least one cold steel beam placed on the rear cambering assembly over the rear hydraulic lift cylinders and restrained by said fourth and fifth means.

2. The cold steel cambering apparatus of claim 1 wherein said first and second and said fourth and fifth means restrain the lateral and upward movements of two cold steel beams placed on the forward and rear cambering assemblies.

3. The cold steel cambering apparatus of claim 2 wherein a forward hydraulic lift cylinder and at least one rear hydraulic lift cylinder are positioned directly under each cold steel beam.

4. The cold steel cambering apparatus of claim 3 wherein the two cold steel beams are the two main beams of a pre-welded trailer frame.

5. A method of providing a camber to a cold steel beam, comprising:

providing a mobile forward cambering assembly having a forward-most end and a rearward-most end and therebetween a plurality of adjustable beam guides, each having first means to restrain lateral movement of at least one cold steel beam placed on the forward cambering assembly, with a plurality of guides at the ends also having second means to restrain upward movement of at least one cold steel beam placed on the forward cambering assembly; and at least one forward hydraulic lift cylinder positioned midway between the ends and directly under at least one cold steel beam placed on the forward cambering assembly with third means to impart a concave camber to at least one cold steel beam placed on the forward cambering assembly over the forward hydraulic cylinder and restrained by said first and second means; and a mobile rear cambering assembly aligned with the forward cambering assembly and having a forward-most end and a rearward-most end and therebetween a plurality of adjustable beam guides, each having fourth means to restrain lateral movement and fifth means to restrain upward movement of at least one cold steel beam placed simultaneously on the rear cambering assembly and the forward cambering assembly, and at least one pair of rear hydraulic lift cylinders positioned to be at the rearward-most end portion of the rear cambering assembly and directly under at least one cold steel beam placed on the rear cambering assembly with sixth means to impart an upward camber to at least one cold steel beam placed on the rear cambering assembly over the rear hydraulic lift cylinders and restrained by said fourth and fifth means; and at least one cold steel beam to be cambered;

adjusting the separation between the rear and forward cambering assemblies in direct relation to the length of at least one cold steel beam of the providing step;

first positioning of at least one cold steel beam of the providing step on the forward cambering assembly with the desired center of a forward concave camber to be imparted to at least one cold steel beam of the providing step over at least one of the forward hydraulic lift cylinder;

second positioning of at least one cold steel beam of the providing step on the rear cambering assembly with the end of at least one beam overlaying at least one rear hydraulic lift cylinders;

capturing at least one cold steel beam of the providing step with the forward and rear adjustable beam guides;

first lifting at least one of the forward hydraulic lift cylinders to bend at least one cold steel beam of the providing step to a point greater than a desired camber in the beam and holding the forward hydraulic lift cylinder at that point;

second lifting at least one of the rear hydraulic lift cylinders to bend at least one cold steel beam of the providing step to a point greater than a desired camber in the beam and holding the rear hydraulic at that point; and lowering the forward and rear hydraulic lift cylinders and checking for desired final camber dimensions in the beam.

6. The method of providing a camber to a cold steel beam of claim 5 wherein said first and second and said fourth and fifth means of the providing step restrain the lateral and upward movements of two cold steel beams placed on the forward and rear cambering assemblies.

7. The method of providing a camber to a cold steel beam of claim 6 wherein a forward hydraulic lift cylinder and at least one rear hydraulic lift cylinder of the providing step are positioned directly under each cold steel beam.

8. The method of providing a camber to a cold steel beam of claim 7 wherein the two cold steel beams are the main beams of a pre-welded trailer frame.

* * * * *